US007153110B2

(12) United States Patent
Schneider

(10) Patent No.: US 7,153,110 B2
(45) Date of Patent: Dec. 26, 2006

(54) VARIABLE VOLUME FLOW INTERNAL GEAR PUMP

(75) Inventor: Willi Schneider, Bodelshausen (DE)

(73) Assignee: Joma-Hydromechanic GmbH, Bodelshausen (DE)

( * ) Notice: Subject to any disclaimer, the term of this patent is extended or adjusted under 35 U.S.C. 154(b) by 194 days.

(21) Appl. No.: 10/501,550

(22) PCT Filed: Nov. 21, 2003

(86) PCT No.: PCT/EP03/13057

§ 371 (c)(1),
(2), (4) Date: Jul. 16, 2004

(87) PCT Pub. No.: WO2004/057191

PCT Pub. Date: Jul. 8, 2004

(65) Prior Publication Data

US 2005/0069447 A1 Mar. 31, 2005

(30) Foreign Application Priority Data

Dec. 19, 2002 (DE) ..... 102 61 779
Feb. 4, 2003 (DE) ..... 103 05 585

(51) Int. Cl.
*F03C 2/00* (2006.01)
*F04C 2/00* (2006.01)
*F04C 18/00* (2006.01)

(52) U.S. Cl. ..... 418/171; 418/19; 418/159; 418/166

(58) Field of Classification Search ..... 418/19, 418/32, 107, 108, 159, 166, 171

See application file for complete search history.

(56) References Cited

U.S. PATENT DOCUMENTS 2,148,561 A 2/1939 Kempton
4,492,539 A * 1/1985 Specht ..... 418/19
6,126,420 A * 10/2000 Eisenmann ..... 418/19

FOREIGN PATENT DOCUMENTS

DE 21 35 861 8/1973
DE 4231690 A1 * 3/1994
DE 102 07 348 9/2002
EP 0 258 797 3/1988
GB 1426223 A * 2/1976
JP 01 066 482 3/1989

* cited by examiner

*Primary Examiner*—Theresa Trieu
(74) *Attorney, Agent, or Firm*—Paul Vincent

(57) ABSTRACT

Rotational pump with variable volume flow, comprising a pump housing having a suction connection and a pressure connection, an outer rotor with inner toothing which is rotatably disposed inside the housing, and an inner rotor with outer toothing which is eccentrically disposed in the outer rotor, and which can be driven by a drive shaft which is disposed in the pump housing parallel to the axis of the outer rotor, wherein a rotatable adjusting ring is provided coaxially to the drive shaft to change the volume flow in the pump housing, and in which the outer rotor is eccentrically and rotatably disposed, characterized in that a slider, which can change the size of at least one of the connections, is disposed, as viewed in the turning direction, between the pressure connection and the suction connection.

14 Claims, 9 Drawing Sheets

VARIABLE VOLUME FLOW INTERNAL GEAR PUMP

This application is the national stage of PCT/EP03/13057 filed on Nov. 21, 2003 and also claims Paris Convention priority of DE 102 61 779.1 filed on Dec. 19, 2002 and of DE 103 05 585.1 filed on Feb. 4, 2003.

BACKGROUND OF THE INVENTION

The invention concerns a rotational pump with variable volume flow, comprising a pump housing having a suction connection and a pressure connection, an outer rotor with inner toothing which is rotatably disposed in the housing interior, and an inner rotor with outer toothing which is eccentrically disposed in the outer rotor, and which can be driven by a drive shaft which is disposed in the pump housing parallel to the axis of the outer rotor, wherein a rotatable adjusting ring, in which the outer rotor is eccentrically and rotatably disposed, is provided coaxially to the drive shaft for changing the volume flow in the pump housing.

DE 102 07 348 discloses rotational pumps, the theoretical supply volume of which can be changed by displacing the center of the outer rotor along a circle, the outer rotor being eccentrically and rotatably disposed in an adjusting ring which is rotatably disposed on the drive shaft in the pump housing, thereby permitting appropriate change of the position of both rotors relative to the suction and pressure connections. In order to avoid repetition, the full disclosure of this reference is hereby incorporated by reference.

It has turned out that when the volume flow is reduced through turning the adjusting ring, the required driving torque for the rotational pump does not change or only changes to a very small extent.

It has turned out to be disadvantageous that the suction stroke already starts before the suction chamber is connected to the suction connection thereby producing an underpressure in the suction chamber which demands drive energy and a drive torque. This underpressure is eliminated when the suction chamber is connected to the suction connection. This is effected in dependence on the position of the adjusting ring, at an earlier or later point in time of the suction stroke. The later that point in time, the larger the torque required to build up the underpressure. It has also turned out that the suction stroke may already start when the suction chamber is still connected to the pressure connection. The suction chamber could already be connected to the suction connection, thereby causing a hydraulic short-circuit.

It is the underlying purpose of the invention to provide a rotational pump of the above-mentioned type, wherein the driving torque is reduced for reduced volume flow.

SUMMARY OF THE INVENTION

This object is achieved in accordance with the invention with a rotational pump of the above-mentioned type by providing a slider, viewed in the direction of rotation, between the pressure connection and the suction connection, which changes the size of at least one of the connections. Preferably, the size of both connections is changed.

This design of the pump has the substantial advantage that the required driving torque is proportional to the required volume flow. In the inventive rotational pump, the size of the pressure connection and/or of the suction connection is/are changed such that the suction stroke starts only after the suction chamber is disconnected from the pressure connection and connected to the suction connection. In other words, the suction chamber is connected to the suction chamber before the suction stroke starts.

This is provided through shifting the start of the suction connection towards the start of the suction stroke.

This prevents generation of an underpressure in the suction chamber thereby reducing the required torque as a result of which the driving torque is proportional to the required volume flow.

In a further development, the pressure connection and the suction connection are formed, at least in sections, as a groove having the shape of a partial circle. Such a groove is easy and inexpensive to produce and the pressure connection and the suction connection may be formed by the same groove. Only a wall is provided between the connections for separation thereof.

The slider is preferably disposed to be displaceable in the groove. The wall separating the connections is formed by the slider which is displaceably disposed in the groove. Clearly, the slider must be fitted into the groove in a fluid-tight fashion using either suitable dimensioning or suitable seals. The wall separating the pressure connection from the suction connection and therefore the end of the pressure connection, viewed in the direction of rotation of the rotor, and the start of the suction connection, viewed in the turning direction, are defined by the slider, whereby the slider, when displaced within the groove, displaces the end of the pressure connection and thereby also the start of the suction connection. The slider thus separates the pressure connection from the suction connection and defines their size. The size of one connection is thereby reduced by the amount by which the size of the other connection is increased.

In accordance with the invention, the slider is designed as a sliding block which fits exactly in the groove. The slider requires no sealing or lubrication.

The slider is preferably driven via the adjusting ring. When the adjusting ring is turned to control the power, the slider is also rotated together therewith. The slider can thereby be displaced by the same angular amount when it is directly connected to the adjusting ring. In another embodiment, the slider is connected to the adjusting ring via a transmission to obtain either gear reduction or multiplication thereby producing less or more displacement of the slider than the adjusting ring.

Further advantages, features and details of the invention can be extracted from the dependent claims and the following description which describes in detail particularly preferred embodiments with reference to the drawing. The features shown in the drawing and mentioned in the description and the claims may be essential for the invention either individually or collectively in arbitrary combination.

DESCRIPTION OF THE PREFERRED EMBODIMENT

Figure 1:
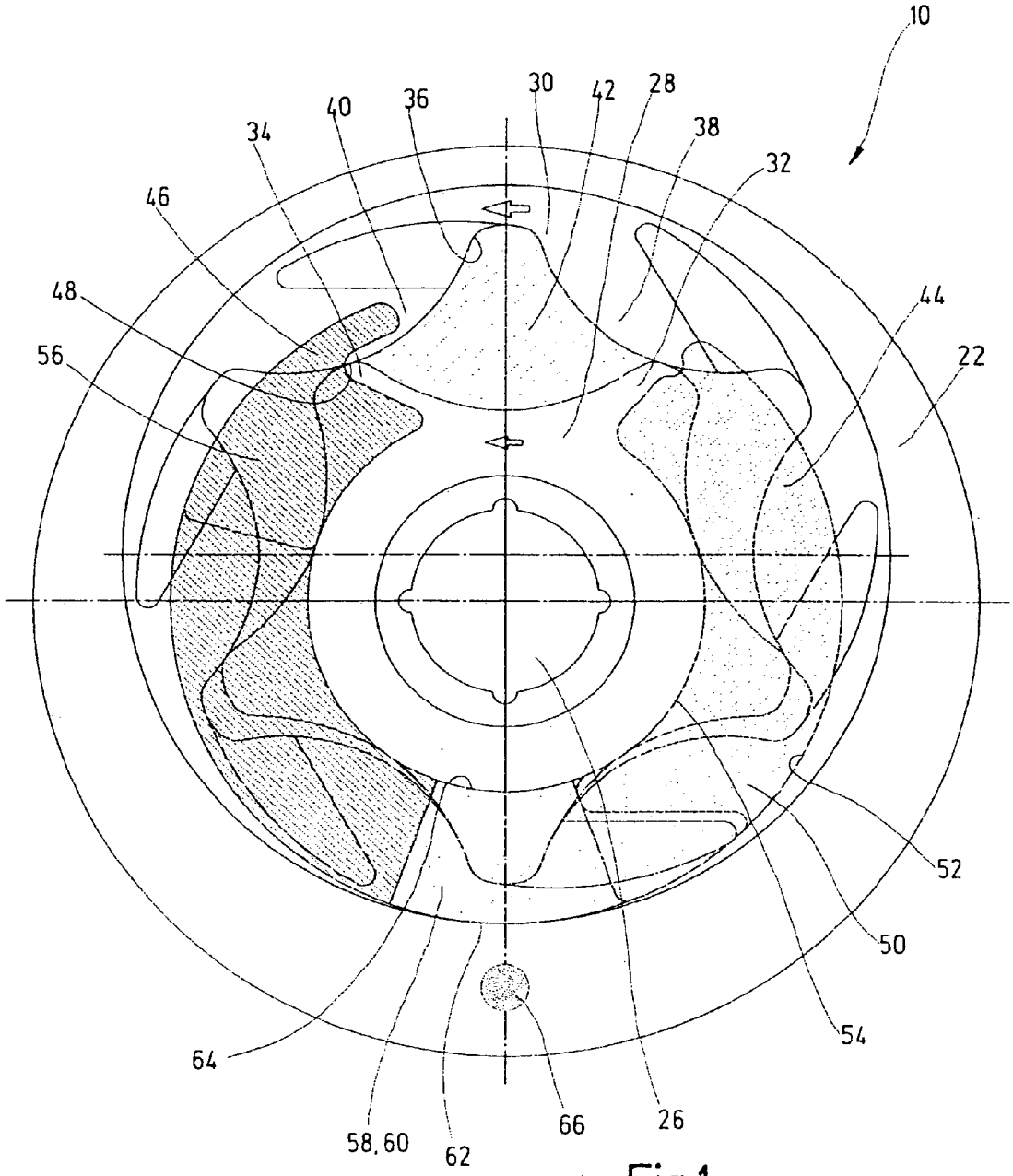
FIG. 1 shows a cross-section through a rotor of a first embodiment of a rotational pump with variable volume flow in its basic position and with maximum volume flow.

The rotor of a rotational pump, designated in total with 10, comprises an adjusting ring 22 which is rotatably and adjustably disposed on a drive shaft 26. An outer rotor 30 which mates with an inner rotor 28 is rotatably and eccentrically disposed in the adjusting ring 22.

A supply chamber 42 is formed between two teeth 32 and 34 of the inner rotor 28 and the inner circumferential surface 36 of the outer rotor 30 disposed between two teeth 38 and 40, in which the fluid suctioned via a suction connection 44 is supplied and loaded with pressure. As soon as a connection 48 between the supply chamber 42 and a pressure connection 46 is produced at 46, the fluid located in the supply chamber 42 is displaced into the pressure connection 46.

FIG. 1 shows the position of the adjusting ring 22 with maximum supply power ($V_{theormax}$) of the rotational pump 10. FIGS. 2 through 5 show the position of the adjusting ring 22 with reduced volume flow.

FIG. 1 clearly shows that the suction connection 44 and the pressure connection 46 are formed by a groove 50 having the shape of a partial circle and having groove walls 52 and 54. This groove 50 is located in a plate disposed behind the plane of the inner rotor 28 and the outer rotor 30. The pressure connection 46 has an outward outlet opening 56 for discharging the pressurized fluid. A slider designated in total with 58 is displaceably guided in the groove 50. The slider 58 which is formed e.g. by a sliding block 60 abuts with its outer surfaces 62 and 64 on the groove walls 52 and 54 in a fluid-tight manner. The slider 58 separates the pressure connection 46 from the suction connection 44 and determines their size. If the slider 58 is displaced in a clock-wise direction in the groove 50, the pressure connection 46 is reduced in size and the suction connection 44 is enlarged. The reference numeral 66 also shows a connection between the slider 58 and the adjusting ring 22. When the adjusting ring 22 is turned in the housing (not shown) surrounding the adjusting ring 22, the slider 58 is turned by this connection 66 by the same angular amount (see FIGS. 2 through 5).

Figure 2:
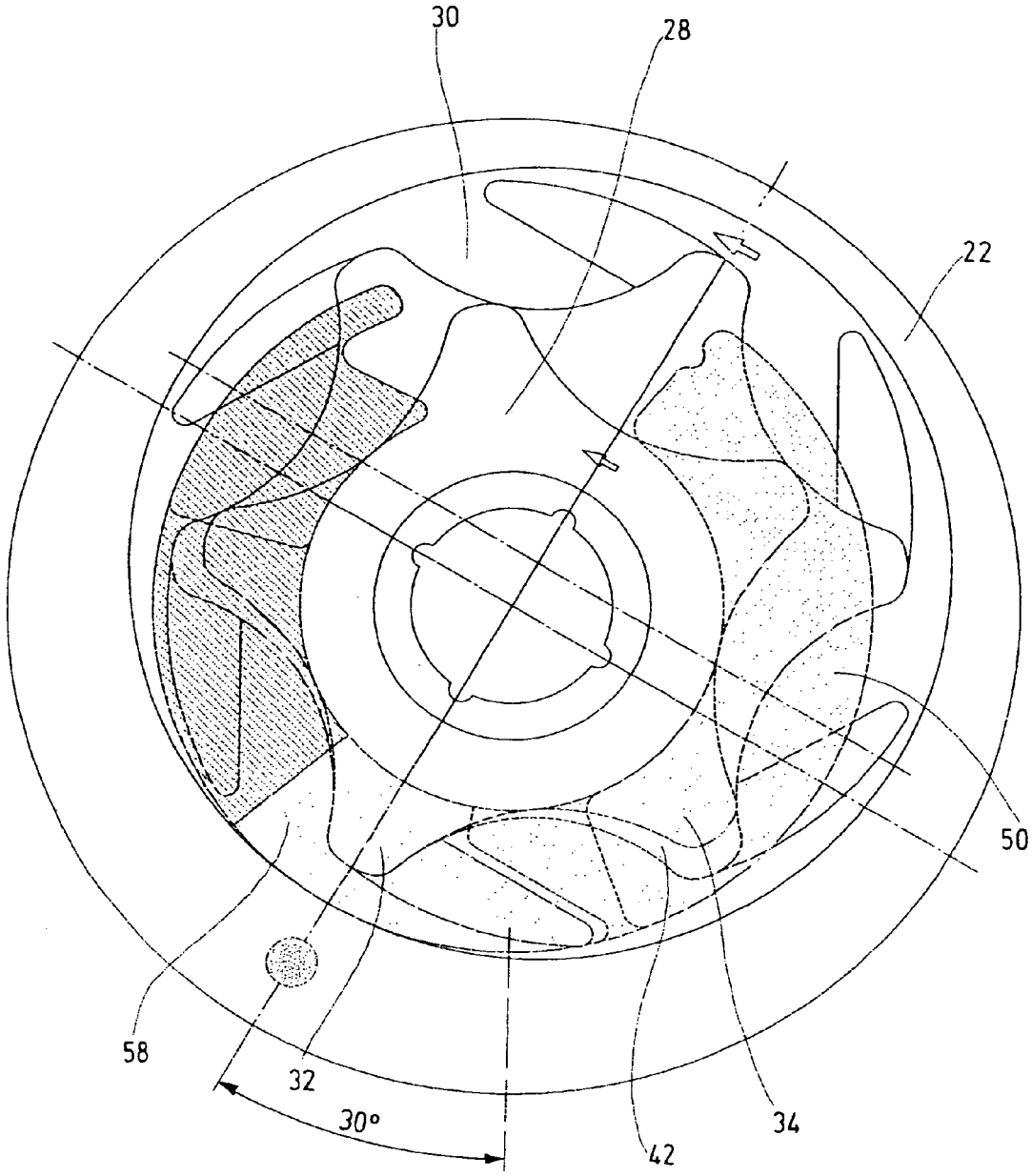
FIG. 2 shows a cross-section through the rotor of the rotational pump with variable volume flow in the basic position with reduced volume flow, wherein the adjusting ring is turned through 30°.

FIG. 2 shows an adjusting ring 22 which is rotated through 30°, wherein the slider 58 is also displaced by 30° in a clock-wise direction within the groove 50. This reduces the size of the pressure connection 46 and increases the size of the suction connection 44. FIG. 2 shows the position of the inner rotor 28 within the outer rotor 30 at the start of the suction stroke, wherein the supply chamber 42 located between the teeth 32 and 34 is increased. This supply chamber 42 is connected to the suction connection 44 to permit fluid to flow into the supply chamber 42.

Figure 3:
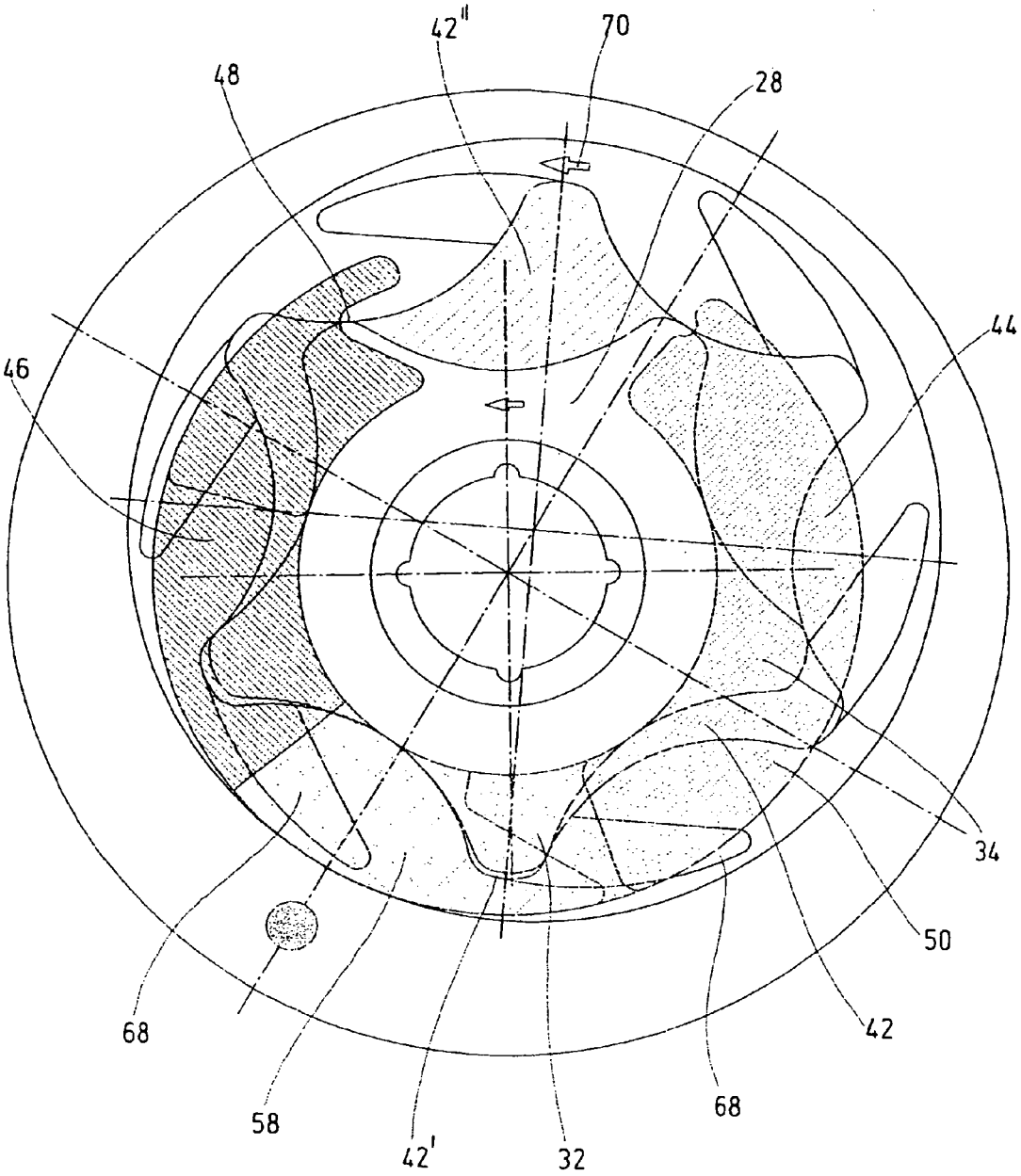
FIG. 3 shows a cross-section through the rotor in accordance with FIG. 2 at the end of the pressure stroke.

In FIG. 3, the inner rotor 28 is turned through approximately 30° in the direction of arrow 70 and it becomes clear that the supply chamber 42 has increased. The next supply chamber 42' is also connected to the suction connection 44 via a bypass groove 68 to prevent generation of underpressure in that next supply chamber 42'. The supply chamber 42" shown in the upper region is reduced compared to FIG. 1 due to turning of the adjusting ring 22 in the direction of a reduced supplied volume flow. As soon as the connection 48 between this supply chamber 42" and the pressure connection 46 is produced, the fluid located in the supply chamber 42" is pressed into the pressure connection 46.

FIGS. 2 and 3 clearly show that no underpressure is generated in the supply chamber 42 or in the supply chamber 42' since both supply chambers 42 and 42' are connected to the suction connection 44 either directly or via the bypass groove 68. This results from the displacement of the slider 58 in the adjusting direction of the adjusting ring 22.

Figure 4:
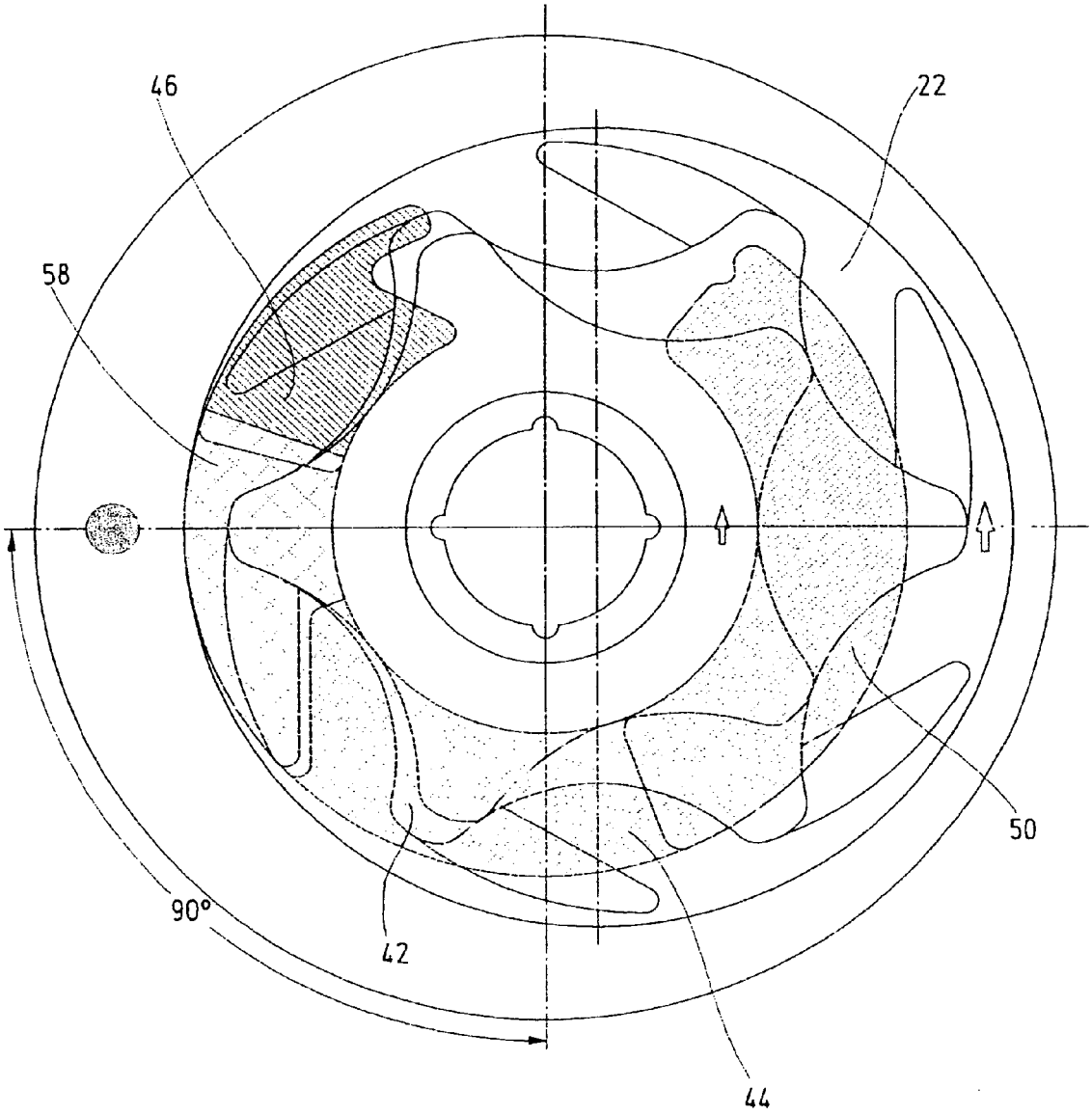
FIG. 4 shows a cross-section through the rotor of the rotational pump with variable volume flow in its basic position with reduced volume flow, wherein the adjusting ring is rotated through 90°.
Figure 5:
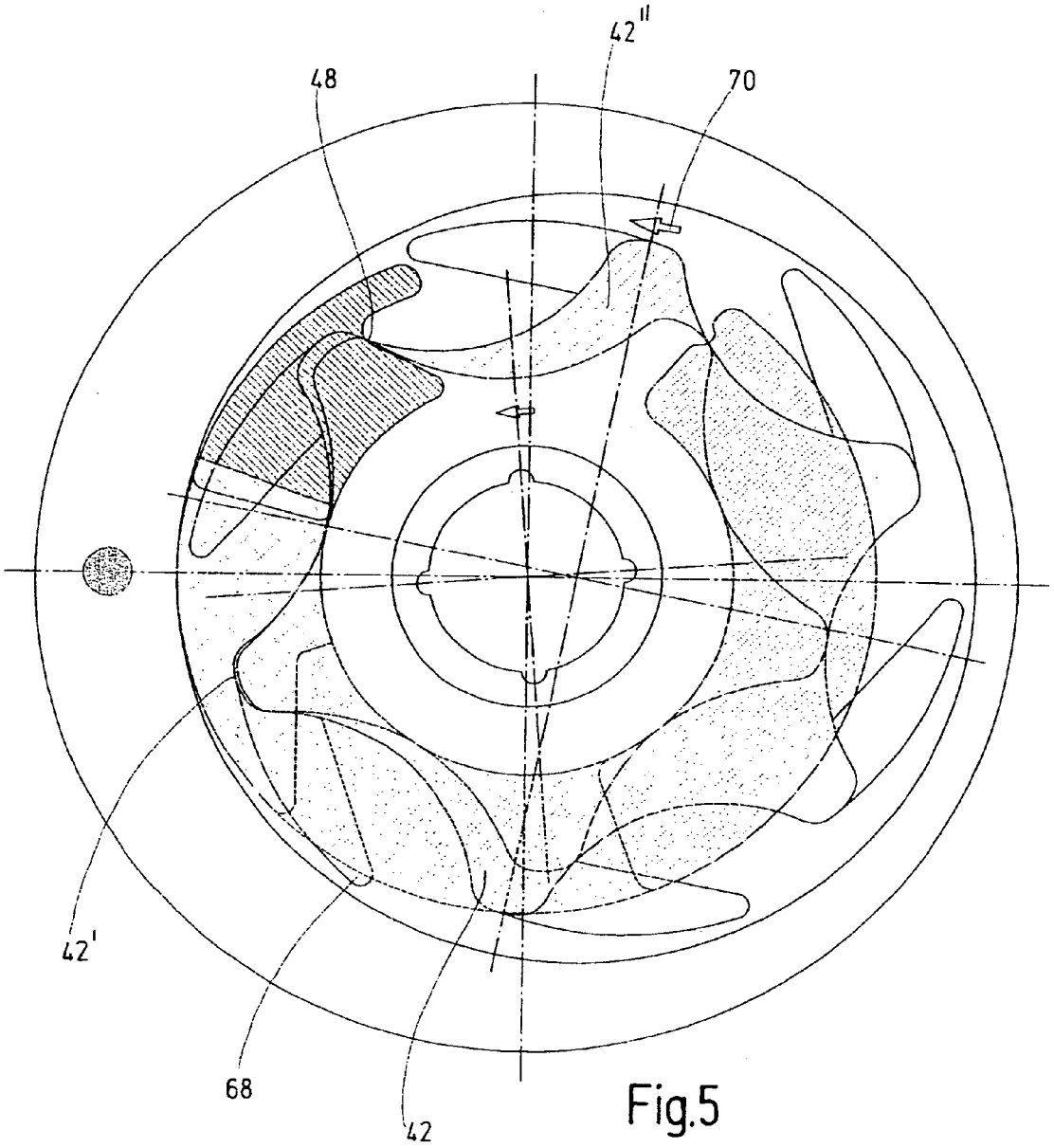
FIG. 5 shows a cross-section through the rotor in accordance with FIG. 4 at the end of the pressure stroke.

In FIGS. 4 and 5, the adjusting ring 22 is rotated through 90° in a clock-wise direction and the slider 58 is located in a position within the groove 50, displaced by 90°. As is clearly shown, the supply chamber 42 is directly connected to the suction connection 44 due to the enlarged suction connection 44 such that no underpressure is generated in the supply chamber 42 or this supply chamber 42 is not connected to the pressure connection 46. This would have been the case if the slider 58 in FIG. 4 assumed the same position as in FIG. 1. In this case, the supply chamber 42 would be connected to the pressure connection 46 and would suction fluid from the pressure connection.

FIG. 5 shows that the supply chamber 42" has been further reduced resulting from larger adjustment of the adjusting ring 22 in the direction of reduced volume flow. The supply chamber 42 also continues to suction via the suction connection 44, wherein the next supply chamber 42' is already connected to the suction connection 44 via the bypass groove 68.

Despite the adjustment of the adjusting ring 22, no underpressure builds up in the supply chamber 42 and the driving torque is thereby reduced.

Figures 6, 7, 8:
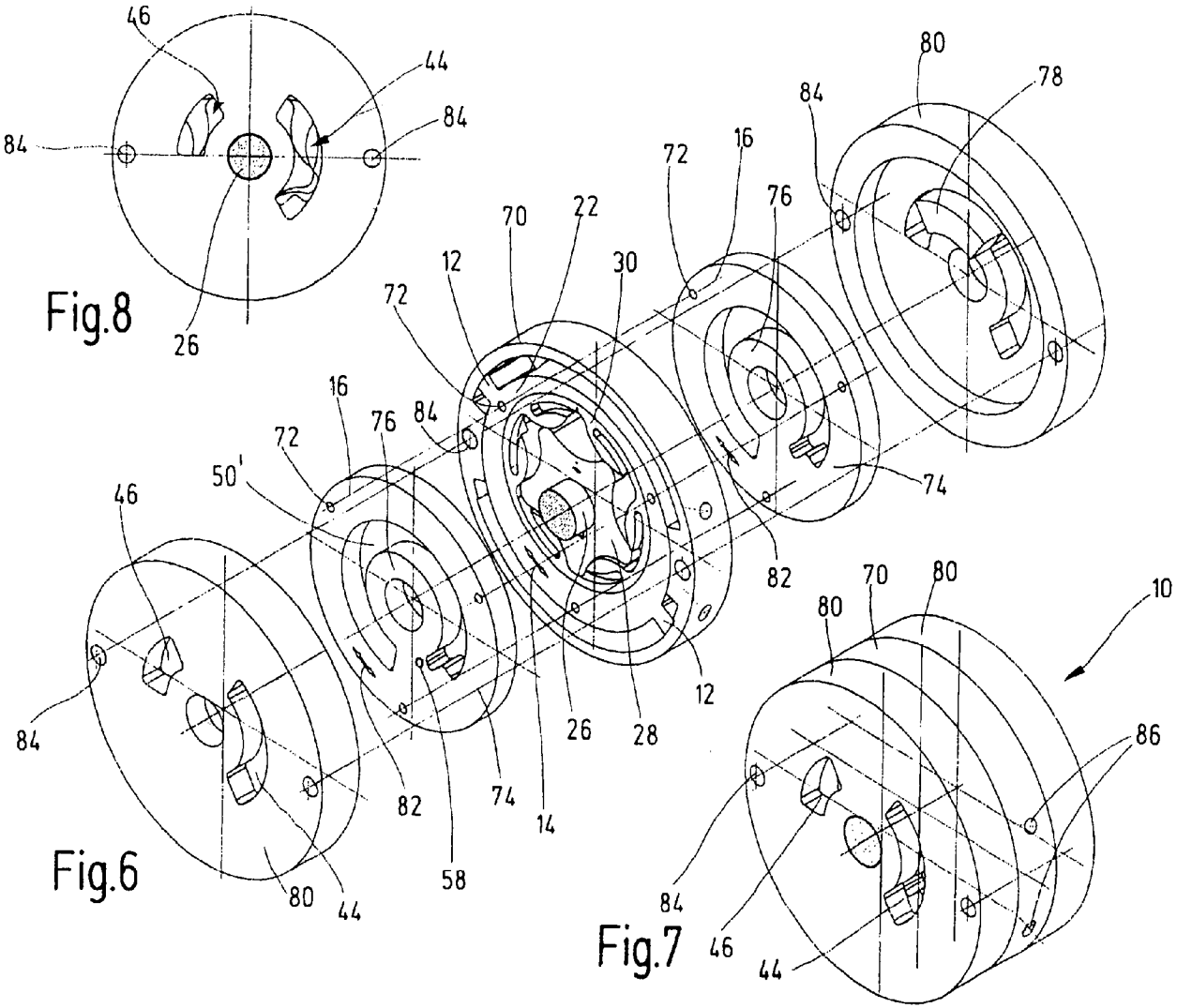
FIG. 6 shows an exploded view of a second embodiment of the rotational pump.
FIG. 7 shows a perspective view of the assembled rotational pump of FIG. 6.
FIG. 8 shows a side view of the rotational pump of FIG. 6.

FIG. 6 shows an exploded view of an embodiment of the rotational pump which is formed from several plate-shaped individual parts. The adjusting ring 22 with its flat pistons 12 is rotatably received in the centrally disposed rotor ring 70. This adjusting ring 22 can be turned within the rotor ring 70 in the direction of the double arrow 14. Two slider plates 16 are disposed on the front sides of the adjusting ring 22 and are connected to the adjusting ring 22 for secure mutual rotation therewith through suitable means such as pins, bolts or the like which engage in holes 72. The slider plate 16 has a groove 50' corresponding to the groove 50 in which the slider 58 is disposed. The slider 58 extends between an outer circular ring 74 and an inner circular ring 76 which surrounds the drive shaft 26. A separator 78, which is provided on a lid 80 receiving the slider plate 70, also engages in the groove 50'. The thickness of the slider plate 16 is exaggerated in the drawing. It is only between 0.5 mm and 1 mm thick and must merely keep the slider 58 at the desired location. The separator 78 therefore has the same thickness.

Since the slider plate 16 is connected to the adjusting ring 22 for secure mutual rotation therewith via pins, bolts or the like disposed in the holes 72, the slider plate 16 is also adjusted in the direction of the double arrow 82 when the adjusting ring 22 is turned in the direction of the double arrow 14. The two lids 80 are connected to the rotor ring 70 via bolts disposed in through holes 84.

FIGS. 6 and 7 show connections 86 for supply and discharge of a fluid for controlling the flat pistons 12.

Figure 11:
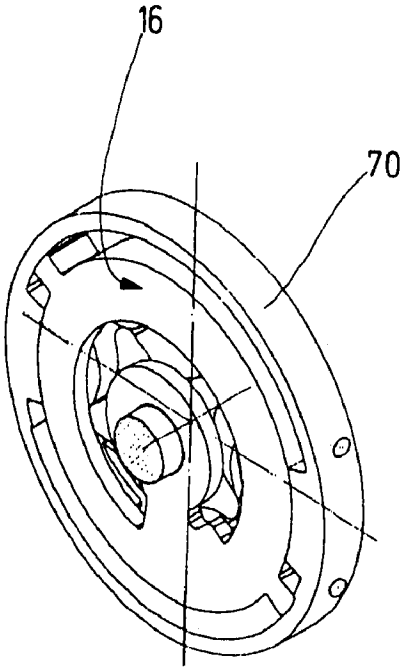
FIG. 11 shows a perspective view of the rotor ring of the third embodiment of the rotational pump.
Figure 10:
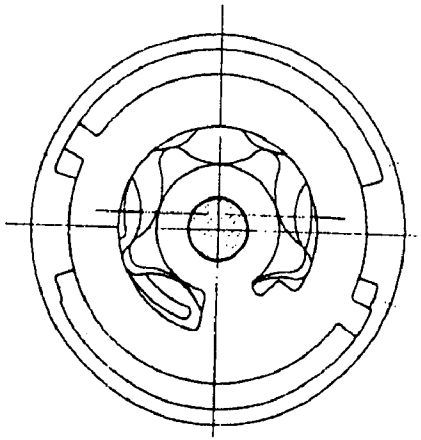
FIG. 10 shows a side view of the slider plate in accordance with FIG. 9.
Figure 9:
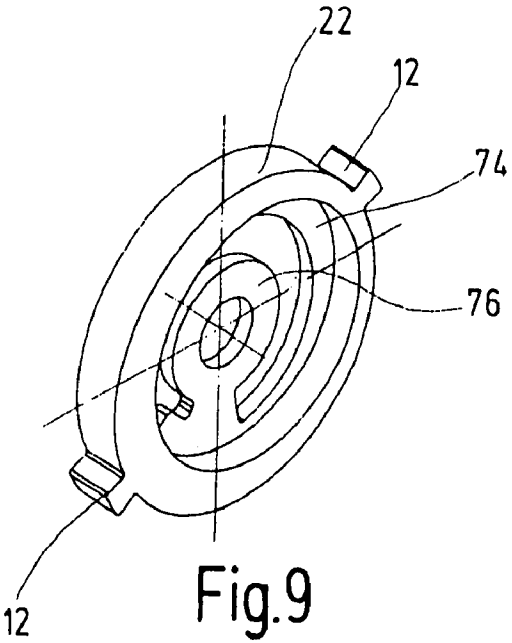
FIG. 9 shows a perspective view of a slider plate of a third embodiment of the rotational pump.

In the embodiment of FIGS. 9 through 11, the adjusting ring 22 is formed in one piece with the slider plate 16 thereby reducing the number of individual parts. The slider plate 16 and the adjusting ring 22 need not be connected.

Figure 12:
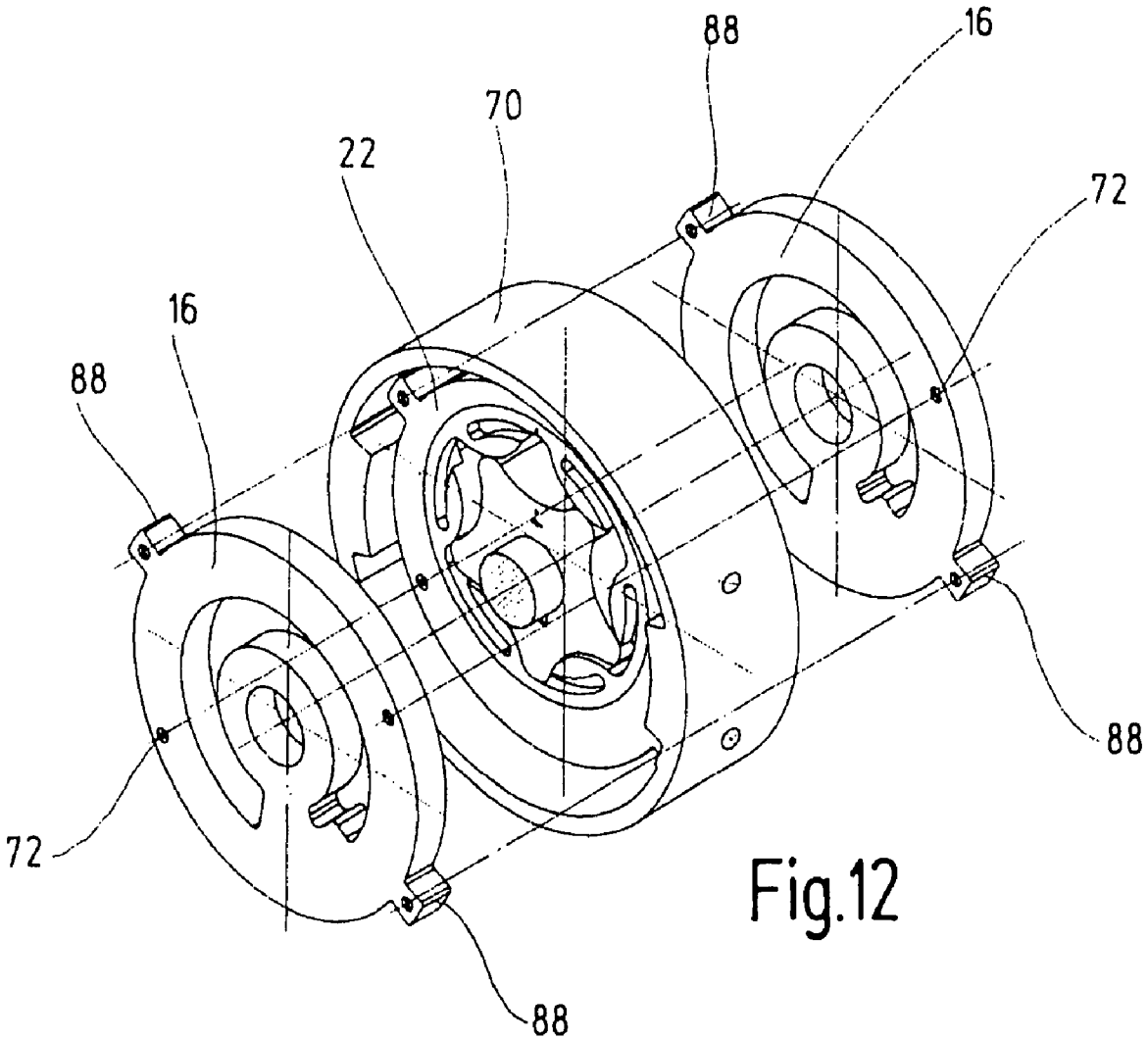
FIG. 12 shows an exploded view of a further embodiment of the rotational pump without lid.

The embodiment shown in FIG. 12 substantially corresponds to the embodiment of FIGS. 6 through 8, wherein the slider plate 16 is provided with flat piston shoulders 88. This has the substantial advantage that the connection between slider plate and adjusting ring 22 can be displaced radially further outwardly, i.e. to the flat piston 12, thereby transmitting larger adjusting forces.

Figure 13:
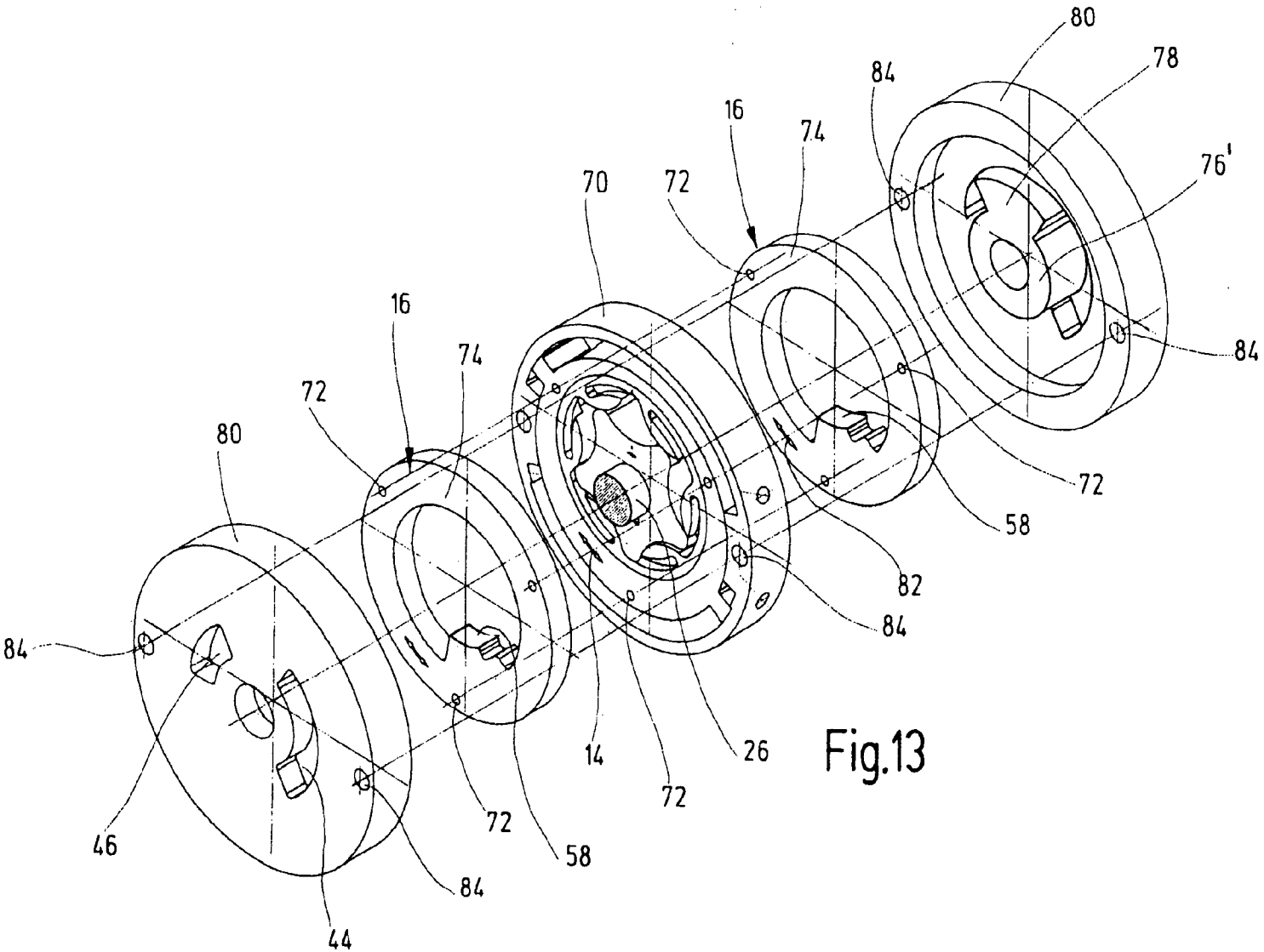
FIG. 13 shows an exploded view of a further embodiment of the rotational pump.

In the embodiment of FIG. 13, the inner circular ring 76 is joined to the lid 80 and forms a circular ring 76' which radially continues into the separator 78. Only the outer circular ring 74 and the slider 58 remain on the slider plate 16.

I claim:

1. A rotational pump having variable volume flow, the pump comprising:

a pump housing having a suction connection and a pressure connection;

an outer rotor having inner toothing, said outer rotor rotatably disposed inside said housing;

an inner rotor having outer toothing, said inner rotor eccentrically disposed in said outer rotor;

a drive shaft disposed in said pump housing, said drive shaft extending parallel to an axis of said outer rotor, said drive shaft cooperating with said inner rotor;

a rotatable adjusting ring, within which said outer rotor is eccentrically and rotatably disposed, said adjusting ring disposed coaxially to said drive shaft; and a slider disposed, as viewed in a turning direction, between said pressure connection and said suction connection, said slider communicating with said adjusting ring to vary a size of at least one of said pressure connection and said suction connection for changing the volume flow in said pump housing, wherein said pressure connection and said suction connection define at least one groove having a shape of a partial circle, with said slider being displaceably disposed in said groove.

2. The rotational pump of claim 1, wherein sizes of both said pressure connection and said suction connection are changed.

3. The rotational pump of claim 2, wherein a size of one connection is increased by a same amount as a size of the other connection is decreased.

4. The rotational pump of claim 1, wherein said slider separates said pressure connection from said suction connection.

5. The rotational pump of claim 1, wherein said slider is formed as a sliding block.

6. The rotational pump of claim 1, wherein said slider is driven via said adjusting ring.

7. The rotational pump of claim 6, wherein said slider is directly connected to said adjusting ring.

8. The rotational pump of claim 6, wherein said slider is connected to said adjusting ring via a transmission.

9. The rotational pump of claim 6, wherein said slider is integral with said adjusting ring.

10. The rotational pump of claim 1, wherein said slider is provided on a slider plate which abuts a front end of said adjusting ring.

11. The rotational pump of claim 10, wherein a lid overlaps said slider plate.

12. The rotational pump of claim 11, wherein said lid defines said pressure connection and said suction connection.

13. The rotational pump of claim 10, wherein said slider plate is integral with said adjusting ring.

14. The rotational pump of claim 1, wherein the pump has a modular construction.

* * * * *